US008992339B2

(12) United States Patent
Matsunaga

(10) Patent No.: US 8,992,339 B2
(45) Date of Patent: Mar. 31, 2015

(54) GOLF CLUB HEAD

(75) Inventor: Kiyofumi Matsunaga, Kobe (JP)

(73) Assignee: SRI Sports Limited, Kobe (JP)

( * ) Notice: Subject to any disclaimer, the term of this patent is extended or adjusted under 35 U.S.C. 154(b) by 570 days.

(21) Appl. No.: 13/325,457

(22) Filed: Dec. 14, 2011

(65) Prior Publication Data

US 2012/0165115 A1 Jun. 28, 2012

(30) Foreign Application Priority Data

Dec. 24, 2010 (JP) ..... 2010-288369

(51) Int. Cl.
*A63B 53/04* (2006.01)
*A63B 53/06* (2006.01)

(52) U.S. Cl.
CPC ..... *A63B 53/0466* (2013.01); *A63B 53/04* (2013.01); *A63B 53/06* (2013.01)
USPC ..... 473/335; 473/345

(58) Field of Classification Search
USPC ..... 473/324–350
See application file for complete search history.

(56) References Cited

U.S. PATENT DOCUMENTS

| | | | | | |
|---|---|---|---|---|---|
| 645,942 | A * | 3/1900 | Cran | 473/336 |
| 1,453,503 | A * | 5/1923 | Holmes | 473/336 |
| 2,460,445 | A * | 2/1949 | Bigler | 473/242 |
| 2,998,254 | A * | 8/1961 | Rains et al. | 473/336 |
| 3,589,731 | A * | 6/1971 | Chancellor, Jr. | 473/333 |
| 3,606,327 | A * | 9/1971 | Gorman | 473/297 |
| 4,008,896 | A * | 2/1977 | Gordos | 473/336 |
| 5,489,097 | A * | 2/1996 | Simmons | 473/326 |
| 6,923,734 | B2 * | 8/2005 | Meyer | 473/336 |
| 7,281,988 | B2 * | 10/2007 | Hou | 473/326 |
| 7,927,231 | B2 * | 4/2011 | Sato et al. | 473/334 |
| 8,182,364 | B2 * | 5/2012 | Cole et al. | 473/335 |
| 8,591,352 | B2 * | 11/2013 | Hirano | 473/336 |
| 2008/0119303 | A1 * | 5/2008 | Bennett et al. | 473/338 |
| 2008/0139333 | A1 * | 6/2008 | Klein | 473/251 |

FOREIGN PATENT DOCUMENTS

| | | | | |
|---|---|---|---|---|
| JP | 09028844 | A * | 2/1997 | A63B 53/06 |
| JP | 11155985 | A * | 6/1999 | A63B 53/06 |
| JP | 2003236025 | A * | 8/2003 | A63B 53/06 |
| JP | 2004-159680 | A | 6/2004 | |
| JP | 2004159680 | A * | 6/2004 | A63B 53/04 |
| JP | 2006101918 | A * | 4/2006 | |
| JP | 2006288793 | A * | 10/2006 | |
| JP | 2007267777 | A * | 10/2007 | |
| JP | 2011005011 | A * | 1/2011 | |
| JP | 2011125623 | A * | 6/2011 | |
| JP | 2012135366 | A * | 7/2012 | |

* cited by examiner

*Primary Examiner* — Alvin Hunter
(74) *Attorney, Agent, or Firm* — Birch, Stewart, Kolasch & Birch, LLP

(57) ABSTRACT

A golf club head 1 comprising a hollow head body 1*b* and a gravity center adjuster 14 fixed to the head body 1*b* and comprising a first weight member 15 and a second weight member 16 having a lower specific gravity than the first weight member 15, wherein the first and second weight members are provided in the head body 1*b* so that the locations thereof are exchangeable with each other, and a depth GL of the center of gravity which is a distance from the head's center of gravity G to a sweet spot SS of a face 2 can be changed by location exchange between the first and second weight members 15 and 16 without substantially changing a distance GK of the center of gravity which is the shortest distance from an axial center line of a shaft-inserting hole 7*a* to the head's center of gravity G.

17 Claims, 9 Drawing Sheets

GOLF CLUB HEAD

BACKGROUND OF THE INVENTION

The present invention relates to a golf club head capable of changing a depth of the center of gravity without substantially changing a distance of the center of gravity.

Performances of golf club heads change greatly by change of a location of the center of gravity. For example, in case of a golf club head that a depth of the center of gravity which is a distance between the center of gravity of a club head and a sweet spot of a club face, is small, it is easy to change the direction of the club head and, therefore, it is easy to manipulate the direction of hitting a golf ball freely. On the other hand, in case of a golf club head having a large depth of the center of gravity, a straight flight property of a hit ball is high because the direction of the club head is hard to change even at mis-shot.

In recent years, there are proposed golf club heads having a good so-called custom fitting that the depth of the center of gravity can be freely changed in accordance with a condition of a golfer or a course layout. For example, as shown in FIG. 10A, this type of a golf club head "a" is composed of a head body "b" having a concave portion or hole "c" which is opened at a back face, a weight "d" which is inserted into the hole "c", and a buffer "e" for adjusting the position of the weight inserted. Thus, a depth "f" of the center of gravity (=distance between a center of gravity "g" and a sweet spot "ss") can be changed to a position that a golfer desires by exchanging the inserting positions between the weight "d" and the buffer "e" as shown in FIGS. 10A and 10B. A similar golf club head is disclosed in JP 2004-159680 A.

This golf club head "a" can change the depth "f" of the center of gravity to a depth "f1" or to a depth "f2" by the position interchange. However, simultaneously, a distance "h" of the center of gravity which is the shortest distance from an axial center line "j" of a shaft-inserting hole "i" to the center of gravity "g" of the head "a", also changes from a distance "h1" to a distance "h2". Thus, the moment of inertia of the golf club head about an axis of a shaft also changes with the position interchange. If the distance "h" of the center of gravity is decreased, the moment of inertia of the golf club head about the shaft axis decreases, so the face tends to turn over the address position at the time of impact and hooking of the ball is easy to occur. On the other hand, if the distance "h" of the center of gravity is increased, the moment of inertia of the golf club head about the shaft axis increases, so the face tends to be difficult to return back to the address position at the time of impact and a slice of the ball is apt to occur. Thus, the golf club head "a" as mentioned above has a problem that performances of the golf club greatly alter.

It is an object of the present invention to provide a golf club head, particularly a wood-type golf club head, which is capable of changing a depth of the center of gravity without substantially changing a distance of the center of gravity.

This and other objects of the present invention will become apparent from the description hereinafter.

SUMMARY OF THE INVENTION

The present invention has achieved the above-mentioned object by interchanging locations of weight members which have different specific gravities from each other and which are to be fixed to a hollow head body of a golf club head.

Thus, in accordance with the present invention, there is provided a golf club head having a face for hitting a golf ball, a shaft-inserting hole to attach a shaft and a hollow interior, said golf club head comprising a hollow head body and a gravity center adjuster fixed to the head body, said gravity center adjuster comprising a first weight member and a second weight member having a lower specific gravity than the first weight member, said first and second weight members being provided in said head body so that the locations thereof are exchangeable with each other, whereby a depth of the center of gravity which is a distance from the center of gravity of the head to a sweet spot of the face can be changed without substantially changing a distance of the center of gravity which is the shortest distance from an axial center line of the shaft-inserting hole to the center of gravity of the head.

The gravity center adjuster is fixed in the hollow interior of the head.

It is preferable that the center of gravity of the first weight member moves substantially on the circumference of a circle whose center is an axial center line of the shaft-inserting hole, or on a tangent to a circle whose center is an axial center line of the shaft-inserting hole, by the location exchange between the first and second weight members.

In an embodiment of the present invention, the hollow head body includes a tubular member having an insertion slot opened at an outer surface of the head, a bottom and a hollow part or hole for inserting the gravity center adjuster, the hollow part extending from the insertion slot into the head's hollow interior and terminating at the bottom; and a cover attached to the insertion slot for preventing the gravity center adjuster from falling out of the hollow part.

The tubular member may be in a right tubular form wherein the hollow part extends straight, or in a curved tubular form wherein the hollow part preferably extends substantially on the circumference of a circle whose center is an axial center line of the shaft-inserting hole.

The tubular member may be in any form, e.g., a cylindrical form or a polyhedral form. The tubular member has a wall facing the hollow interior of the head, and the wall may be provided with an opening extending in an axial direction of the hollow part. Further, an inner surface of the wall may be in any form, e.g., a cylindrical form or a polyhedral form.

The gravity center adjuster may further include an elastic member having a lower specific gravity and a lower elasticity than those of the first and second weight members. The elastic member is disposed in the hollow part of the tubular member in a state of being compressed in an axial direction of the tubular member. Preferably, the elastic member is disposed in contact with the bottom of the tubular member.

It is preferable that the first and second weight members have a different length from each other. It is more preferable that a length L2 of the first weight member having a larger specific gravity which is measured along an axial direction of the hollow part is smaller than a length L1 of the second weight member having a smaller specific gravity which is measured along an axial direction of the hollow part.

The tubular member may be fixed to a sole portion of the head which provides a bottom of the head, for example, through a supporting member by welding, or by integral molding by means of casting.

The tubular member may be formed from a material having a smaller specific gravity than the sole portion and may be fixed to the sole portion by adhesion or mating.

The golf club head according to the present invention can easily change the depth of the center of gravity without substantially changing the distance of the center of gravity by location exchange between the first and second weight members. Since such a golf club head can adjust only the gravity center depth independently of the gravity center distance, it is possible to easily alter the golf club, for example, to a club which is easy to freely manipulate the direction of hitting a golf ball by decreasing the gravity center depth, or to a club which is easy to stabilize the direction of a ball hit by increasing the gravity center depth.

DETAILED DESCRIPTION OF THE INVENTION

An embodiment of the present invention will be explained below with reference to the accompanying drawings.

Figure 1:
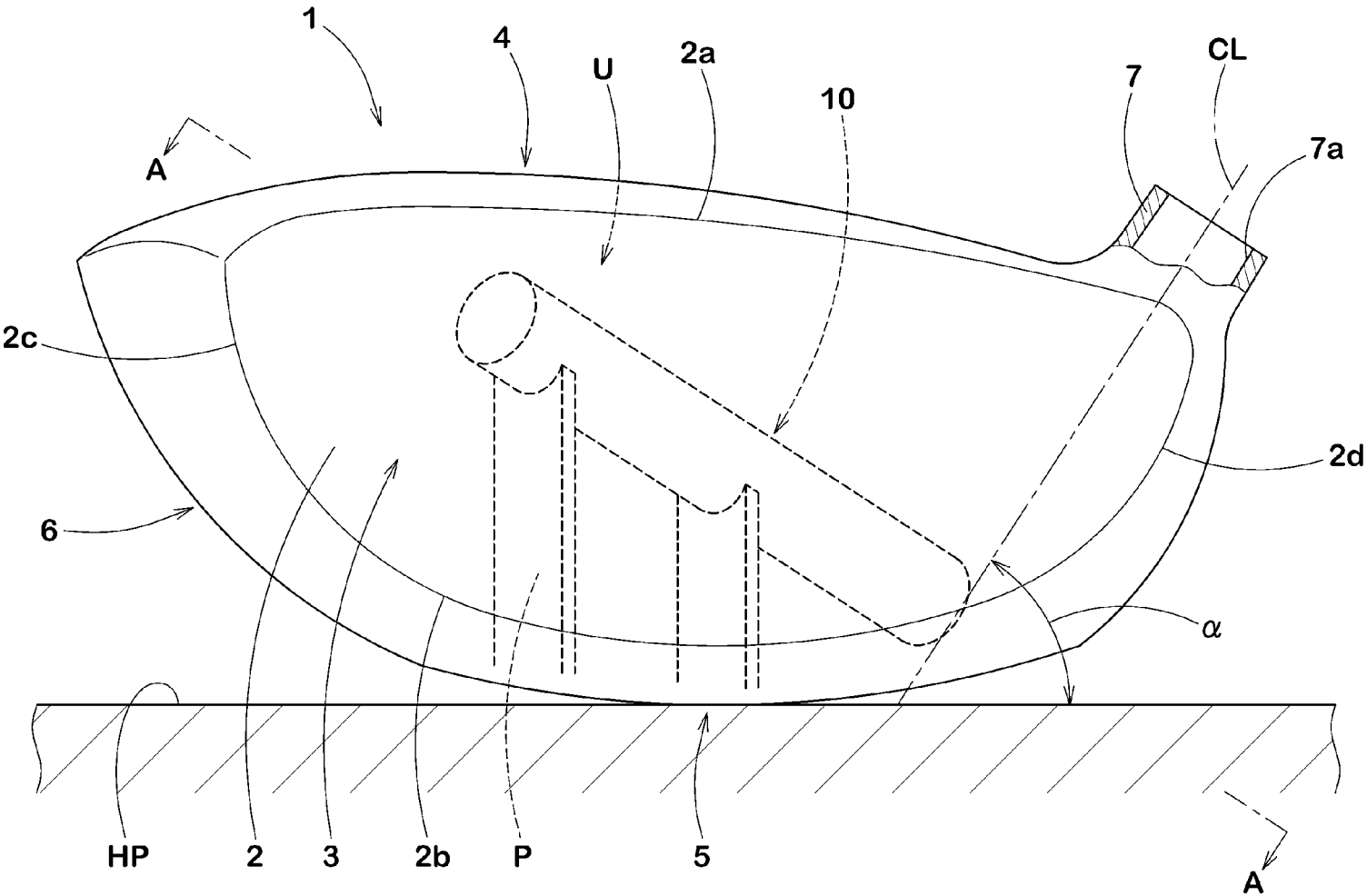
FIG. 1 is a front view of a golf club head in the standard state according to an embodiment of the present invention.
Figure 2:
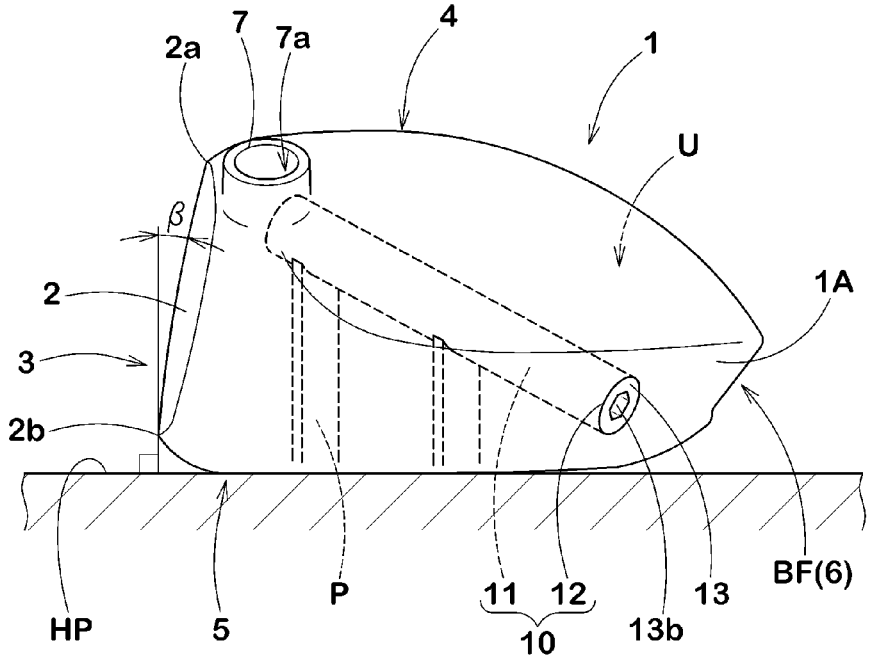
FIG. 2 is a side view of the club head of FIG. 1 viewed from the heel side.
Figure 3:
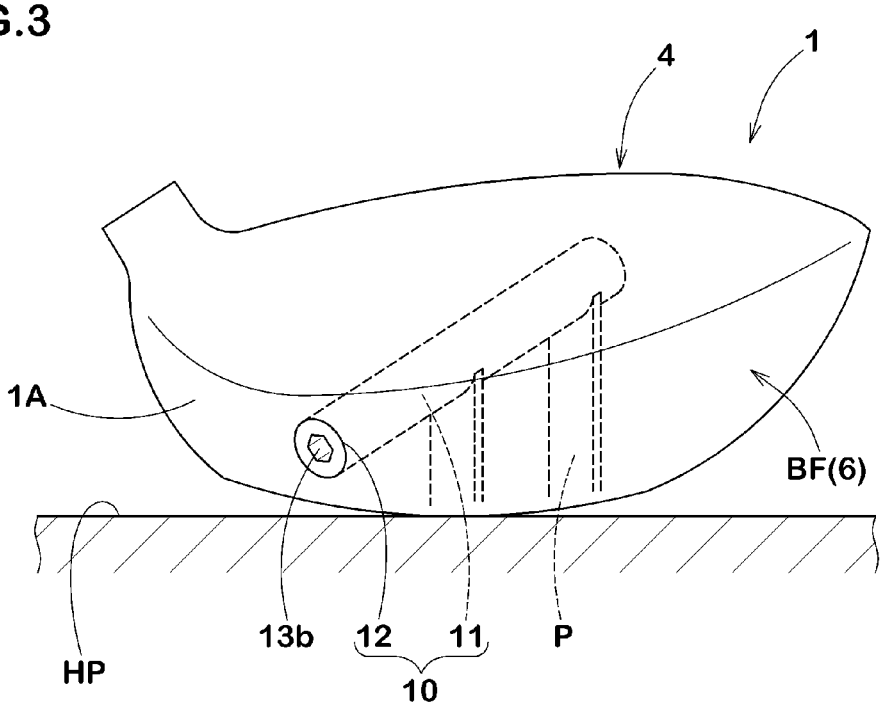
FIG. 3 is a back view of the club head of FIG. 1.

FIGS. 1 to 3 show a golf club head 1 in a standard state according to an embodiment of the present invention. The term "standard state" as used herein denotes the state that the club head 1 is placed on a horizontal plane HP with keeping prescribed lie angle $\alpha$ and loft angle $\beta$ (shown in FIG. 2). The golf club head 1 shown in the drawings is placed in the standard state unless otherwise noted.

Figure 4:
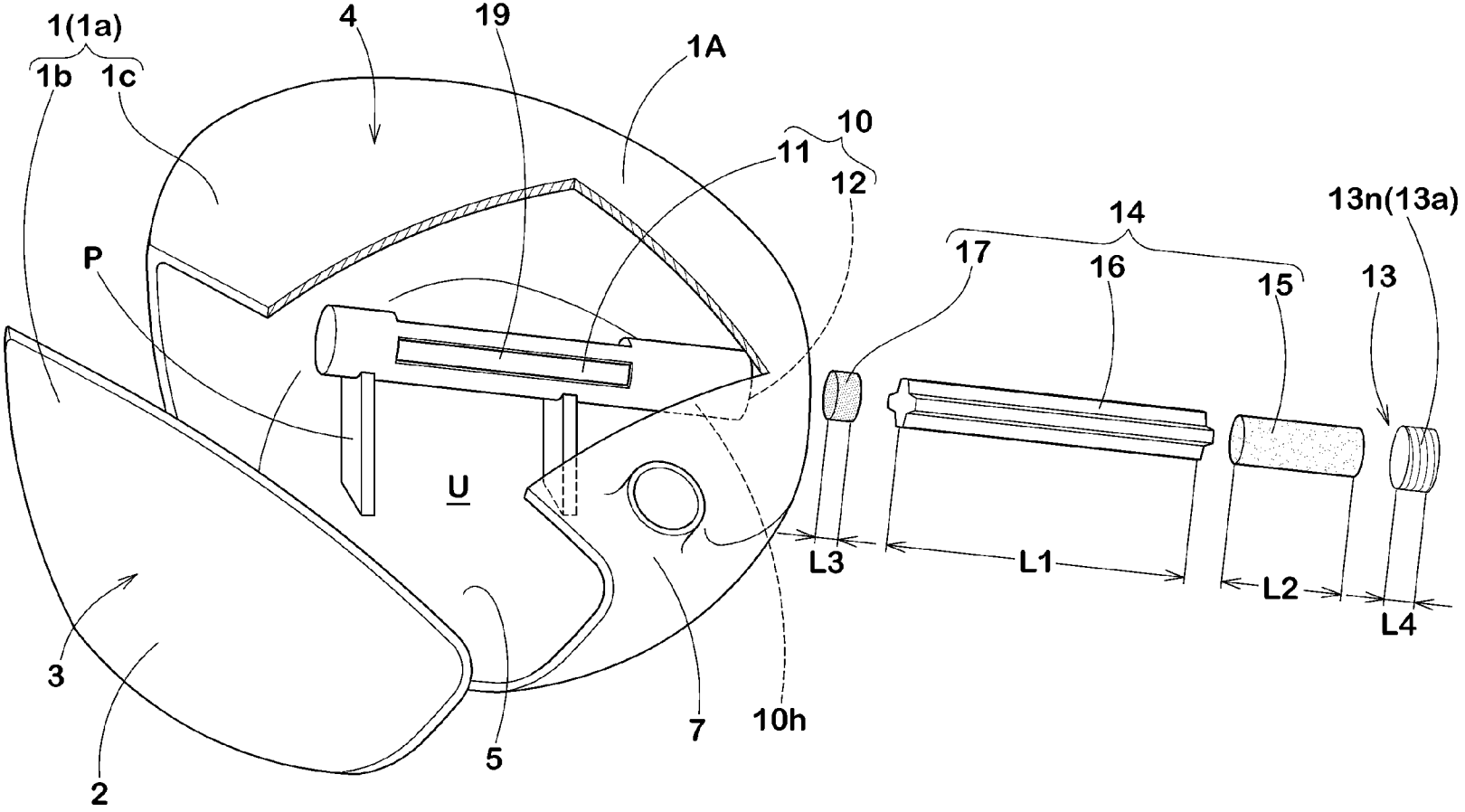
FIG. 4 is a partially cutaway perspective view of the club head of FIG. 1.

The golf club head 1 in this embodiment comprises a head body 1*a* having a hollow structure, and a gravity center adjuster 14 fixed to the head body 1*a*, as shown in a partially cutaway view of FIG. 4.

The head body 1*a* includes a face portion 3 having a face 2 for hitting a golf ball on its front side, a crown portion 4 which extends from an upper edge 2*a* of the face 2 and forming the upper surface of the head 1, a sole portion 5 which extends from an lower edge 2*b* of the face 2 and forming the bottom surface of the head 1, a side portion 6 which extends between the crown portion 4 and the sole portion 5 to connect them from a toe side edge 2*c* of the face 2 to a heel side edge 2*d* of the face 2 through a back face BF of the head 1, and a hosel portion 7 which is disposed on a heel side of the crown portion 4 for inserting a shaft and which has a shaft inserting hole 7*a* to attach a shaft (not shown). The head body 1*a* has a hollow interior U. Since the axial center line of the shaft inserting hole 7*a* substantially agrees with the axial center line CL of the shaft when the shaft is inserted into the hole 7*a*, it is used as the axial center line CL of the shaft when no shaft is attached to the club head 1.

Preferably, the head body 1*a* is formed to provide wood-type golf club heads such as driver (#1) and fairway woods.

The head body 1*a* in this embodiment is made of a metallic material. The metallic material is not particularly limited. Examples of the metallic material are, for instance, an aluminum alloy, a titanium alloy, a stainless steel, and other metallic materials known to use in the production of golf club heads. The head body 1*a* can be produced by known methods, for example, by joining a plurality of members or pieces in a known manner, e.g., welding, adhesion, swaging, or brazing. Each member or piece is formed by various molding methods, e.g., casting, forging and pressing.

The head body 1*a* in this embodiment has a two piece structure and is produced from a face plate 1*b* constituting a main part of the face portion 3, and an integrally formed head base body 1*c* to which the face plate 1*b* is welded. However, the present invention is not particularly limited to such an embodiment.

From the viewpoints of large moment of inertia and improvement in flight directionality and swing balance, it is preferable that the club head 1 of the present invention has a head volume of at least 380 $cm^3$, especially at least 400 $cm^3$, and it has a head volume of at most 470 $cm^3$, especially at most 460 $cm^3$. From the same viewpoints as above, it is also preferable that the total weight of the club head 1 is at least 175 g, especially at least 180 g, and it is at most 220 g, especially at most 215 g.

As shown in FIGS. 1 to 4, the head body 1*a* includes a tubular member 10 having an insertion slot 12 opened at an outer surface 1A of the head, a bottom 11*b* and a hollow part or hole 11 extending from the insertion slot 12 into the head's hollow interior U and terminating at the bottom 11*b*; and a cover 13 attached to the insertion slot 12.

The tubular member 10 is in an approximately cylindrical shape extending straight in its longitudinal direction. It is fixed to head body 1*a*, for example, to an inner surface of the sole portion 5 through a supporting member P. The tubular member 10 can be provided in the head body 1*a* by various methods so long as it does not come off by impact received at the time of hitting a ball or the like. For example, the tubular member 10 may be integrally formed with the head body 1*a* by casting. The tubular member 10 in this embodiment is disposed so that in the standard state, the height measured from the horizontal plane HP gradually increases from the inserting slot 12 to the bottom 11*b*.

Figure 5A:
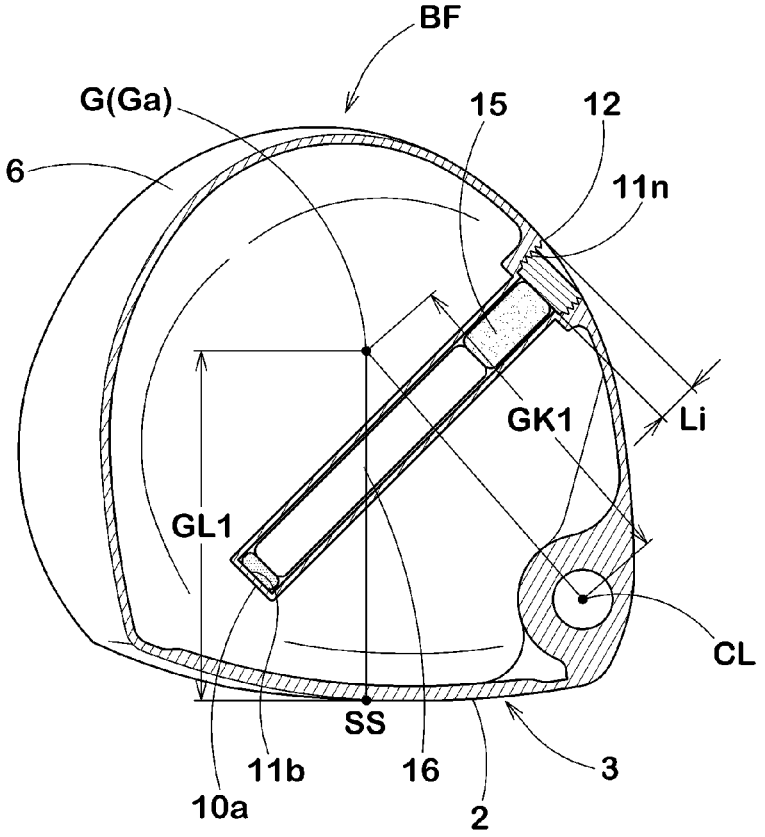
FIG. 5A is a cross sectional view of the club head when it has a larger depth of the center of gravity.

Further, as shown in FIG. 5A, a front end 10*a* of the tubular member 10 is located in the hollow interior U of the head body 1*a* without contacting a rear surface of the face 2. A rear end of the tubular member 10 extends toward a heel side of and a back face BF side of the side portion 6 and is opened at an outer surface of the side portion 6. Thus, the hollow part 11 inside the tubular member 10 extends from the insertion slot 12 opened at the head's outer surface 1A on the heel side of the side portion 6 toward a toe side of the face 2.

The hollow part 11 is a space in the form of an approximately circular column. The gravity center adjuster 14 is inserted into this space, i.e., hollow part 11 of the tubular member 10. The tubular member 10 has a smooth inner surface facing the hollow part 11, provided that a female screw portion 11*n* for attaching the cover 13 may be formed in the inner surface within an area having an axial constant distance Li from the insertion slot 12.

The cover 13 has an approximately disc-like shape as shown in FIG. 4, but the shape is not limited thereto. A male screw portion 13*a* to be fitted to the female screw portion 11*n* of the tubular member 10 is formed in an outer peripheral surface 13*n* of the cover 13. The gravity center adjuster 14 can be prevented from getting out of the tubular member 10 by screwing the cover 13 onto the tubular member 10. It is desirable to form a groove on a head's outer surface side of the cover 13 so that the cover 13 is easily detachable by a tool such as a screw driver or a special tool.

The gravity center adjuster 14 in this embodiment comprises a first weight member 15 having a higher specific gravity and a second weight member 16 having a lower specific gravity than the first weight member 15, and an elastic member 17 having a lower specific gravity and a lower elasticity than those of the first and second weight members 15 and 16.

The first and second weight members 15 and 16 are disposed in the head body 1*a* so that the locations thereof are exchangeable with each other in the hollow part 11 of the tubular member 10. Thus, the golf club head 1 of the present invention is constituted so that a depth GL of the center of gravity which is a distance from the center of gravity G of the head 1 to a sweet spot SS of the face 2 can be changed without substantially changing a distance GK of the center of gravity which is the shortest distance from an axial center line CL of the shaft-inserting hole 7*a* to the center of gravity G of the head 1, by the location exchange between the first weight member 15 and the second weight member 16.

Figure 5B:
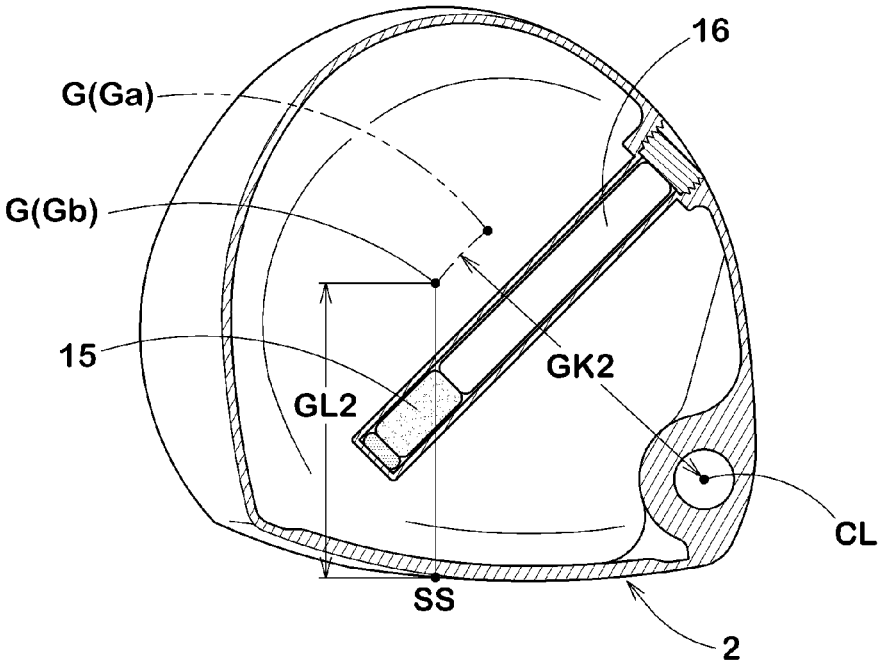
FIG. 5B is a cross sectional view of the club head when it has a smaller depth of the center of gravity.

An embodiment of such a constitution for realizing the change of the gravity center depth GL without substantial change of the gravity center distance GK is shown in FIGS. 5A and 5B. By the way, FIGS. 5A, 5B, 6, 8A, 8B and 9 show cross sectional views along the line A-A of FIG. 1 wherein the head 1 is cut at a plane passing through the head's center of gravity G and being parallel to the horizontal plane HP in a state that the shaft-inserting hole 7*a* is set up vertically with respect to the horizontal plane HP. FIG. 5A shows a state that the first weight member 15 is disposed in the hollow part 11 on its back face side BF and the second weight member 16 is disposed in the hollow part 11 on its face 2 side. FIG. 5B shows a state that location exchange has been made between the first weight member 15 and the second weight member 16 from the state shown in FIG. 5A. As apparent from FIGS. 5A and 5B, the center of gravity G of the head 1 shifts from a point Ga to a point Gb by the change of the location of the weight member 15. With this change, the depth GL of the center of gravity of the head 1 decreases from GL1 to GL2. Further, the distance GK of the center of gravity changes from GK1 to GK2, but no substantial change is found between the distance GK1 before the location exchange and the distance GK2 after the location exchange. For convenience of explanation, the center of gravity Ga of the head 1 before the location exchange is also shown in FIG. 5B.

The expression "without substantial change" or the like means that a change of a degree exerting no influence on hitting by a golfer is tolerated. As a result of inventor's investigation by actual hitting tests, it has been found that an influence on the gravity center depth GL with respect to a directionality of a hit ball is small when an amount of change (GK2−GK1) in the gravity center distance GK by the location exchange between the first weight member 15 and the second weight member 16 is 1.0 mm or less. Therefore, when the amount of change (GK2−GK1) is from 0 to 1.0 mm, the gravity center distance GK is regarded as substantially unchanged.

Figure 6:
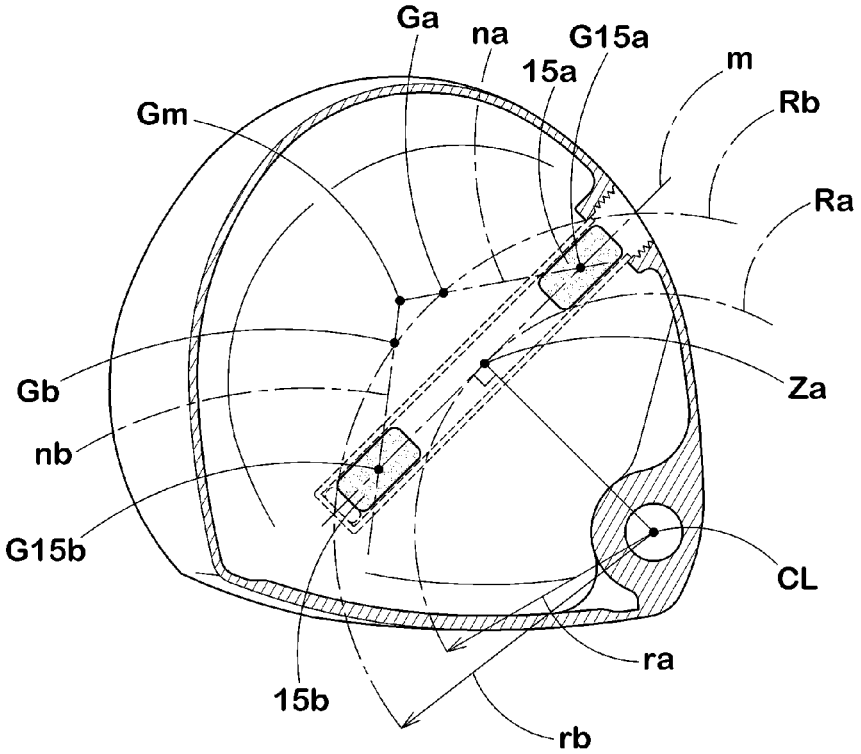
FIG. 6 is a cross sectional view showing another embodiment of the present invention.

Another embodiment of the constitution for realizing the change of the gravity center depth is shown in FIG. 6.

In the embodiments shown in FIGS. 5A, 5B and 6, it is preferable that the center of gravity G15 of the first weight member 15 moves substantially on a tangent line "m" to a circle Ra having a radius "ra" whose center is an axial center line CL of the shaft-inserting hole 7*a* by the location exchange between the first and second weight members. In the embodiment shown in FIG. 6, the center of gravity G15 of the first weight member 15 moves from G15*a* to G15*b*. Since the center of gravity Gm of the club head 1 except the first weight member 15 is limited to a specific location depending on the shape of the club head 1, the center of gravity G of the head 1 to which the first weight member 15 is added is located at a position Ga or Gb allocating a straight line "n" connecting the center of gravity G15 of the first weight member 15 and the center of gravity Gm of the club head 1 except the first weight member 15 in a weight ratio of the both members, i.e., the first weight member 15 and the club head 1 except the first weight member 15. Symbol "na" denotes the line "n" before the location exchange, and symbol "nb" denotes the line "n" after the location exchange. When the location for disposing the first weight member 15 is set as shown in this embodiment in view of the relationship mentioned above, the center of gravity G of the head 1 moves from Ga to Gb on a circumference Rb of a circle having a radius "rb" (corresponding to the gravity center distance GK) whose center is an axial center line CL of the shaft-inserting hole 7*a*. Thus, the golf club head 1 of the present invention can change the depth GL of the center of gravity without substantially changing the distance GK of the center of gravity. In FIG. 6 are shown two first weight members 15 for convenience sake, since the states before and after the location exchange of the first weight member 15 are shown in a single drawing.

As shown in FIG. 6, it is more preferable that the centers of gravity G15*a* and G15*b* of the first weight member 15 before and after the location exchange are located symmetrically with respect to a contact point Za between the tangent line "m" and the circle Ra. In such a preferable embodiment, the centers of gravity Ga and Gb of the club head 1 before and after the location exchange are more easy to locate on the circumference Rb of the circle having its center at the axial center line CL of the shaft-inserting hole 7*a*.

The gravity center distance GK of the head 1 increases with increase of the radius "r" of the circle R, so the moment of inertia about the axial center line CL increases. Therefore, in that case, there is a tendency that the face is hard to return to a state in address when hitting a ball and a slice is easy to occur. On the other hand, if the radius "r" of the circle R is too small, there is a tendency that the face is easy to return excessively over the address state when hitting a ball and a hook is easy to occur. In view of such points, it is preferable that the radius "r" of the circle Ra is at least 36 mm, especially at least 38 mm, and it is at most 43 mm, especially at most 41 mm.

From the viewpoint of securing the volume and rigidity of the club head, it is preferable that a specific gravity "ph" of the head body 1*a* is at least 4.30, especially at least 4.35, and is at most 4.45, especially at most 4.43.

As understood from FIGS. 5 and 6, the first weight member 15 contributes largely to the change in the center of gravity G of the head. Therefore, it is preferable that a length L2 in the axial direction of the member 15 is relatively small, and a length L1 in the axial direction of the second weight member 16 is relatively large, whereby the gravity center position of the first weight member 15 can be moved largely, so the gravity center depth GL can be changed more largely without substantially changing the gravity center distance GK of the head 1.

It is particularly preferable that a ratio L1/L2 is at least 2.0, especially at least 3.0, since a large difference (change) in gravity center depth, e.g., a difference of 3 mm or more, can be obtained. On the other hand, if the ratio L1/L2 is too large, the center of gravity is hard to shift even if location exchange is conducted between the first and second weight members. Therefore, it is preferable that the ratio L1/L2 is at most 10, especially at most 8.

An axial length L of the hollow part 11 is preferably at least mm, more preferably at least 65 mm, and is preferably at most 100 mm, more preferably at most 90 mm. To sufficiently secure the length L of the hollow part 11 is effective for obtaining a large amount of adjustment for the gravity center depth of the head 1. The length L of the hollow part 11 denotes a length from the bottom 11*b* of the tubular member 10 to a bottom end of the cover 13 inserted into the insertion slot 12, that is to say, an effective length capable of holding the gravity center adjuster 14, of the tubular member 10 except the female screw portion 11*n*.

The axial length L2 of the first weight member 15 is not particularly limited, but if the length L2 is too large, the amount of change in the gravity center depth is small even if the location exchange is conducted with the second weight member 16. Further, if the length L2 is too small, the weight of the first weight member 15 excessively decreases, so a large amount of change in gravity center depth is hard to be obtained. From such points of view, it is preferable that the axial length L2 of the first weight member 15 is at least 7 mm, especially at least 9 mm, and is at most 25 mm, especially at most 23 mm.

Similarly, if the specific gravity "ρo" and/or weight Wo of the first weight member 15 are too small, there is a possibility that the position of the center of gravity of the head 1 cannot be greatly changed even if the position of the member 15 is changed. Further, if they are too large, a swing balance tends to deteriorate since the weight of the club head 1 itself excessively increases. From such points of view, it is preferable that the specific gravity "ρo" of the first weight member 15 is at least 6.0, especially at least 7.0, and is at most 18.0, especially at most 16.0. Similarly, it is preferable that the weight Wo of the first weight member 15 is at least 8.0 g, especially at least 9.5 g, and is at most 20.0 g, especially at most 18.0 g.

Examples of the metallic material of such first weight member 15 are, for instance, stainless steel, tungsten, tungsten alloy, copper alloy, nickel alloy, and combinations of two or more of these metals.

From the viewpoint of securing a sufficient amount of movement of the first weight member 15 when exchanging the positions, the length L1 of the second weight member 16 is preferably at least 30 mm, more preferably at least 35 mm. On the other hand, if the length L1 is too large, the length L2 of the first weight member 15 is excessively decreased since the hollow part 11 has a limited length. Therefore, the length L1 of the second weight member 16 is preferably at most 70 mm, more preferably at most 65 mm.

The smaller the specific gravity "ρk" and weight Wk of the second weight member 16 are, the better since a larger weight can be allocated to the first weight member 15. However, it is also important to have a sufficient strength and an adequate rigidity. From such points of view, it is preferable that the specific gravity "ρk" of the second weight member 16 is at least 0.9 and at most 1.7. Similarly, it is preferable that the weight Wk of the second weight member 16 is at least 2.5 g and at most 4.5 g.

Thus, the second weight member 16 is preferably made of a lightweight material having an adequate rigidity. Examples of such material are, for instance, polymeric materials such as polyethylene (PE), polyamide (nylon resins), polyurethane (PU), fluorine-containing resin (e.g., Teflon™), and other resin materials.

If the hardness of the second weight member 16 is too small, the member 16 easily causes plastic deformation when the cover 13 is attached and, therefore, there is a possibility that the location of the member 16 is not stable. From such a point of view, it is preferable that the second weight member 16 have a Shore D hardness of at least 60, especially at least 65. As to the upper limit thereof, it is preferable that the second weight member 16 have a Shore D hardness of about 95 or less, especially about 90 or less.

Figure 7A:
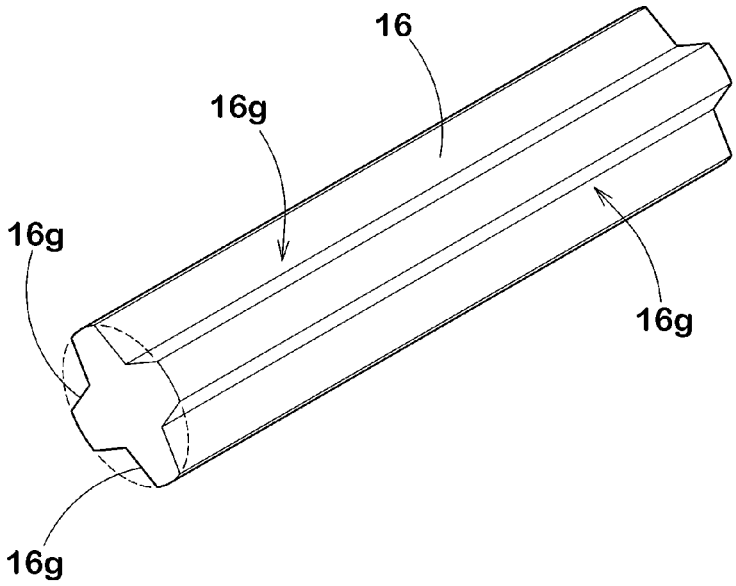
FIG. 7A is a perspective view showing an example of the second weight member.
Figure 7B:
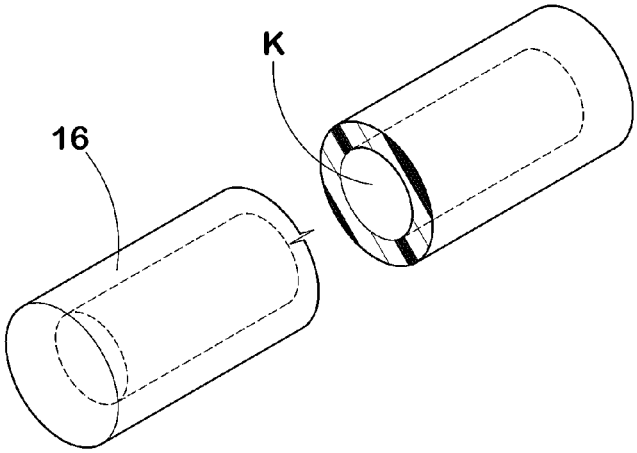
FIG. 7B is a perspective view showing another example of the second weight member.

The shape of the second weight member 16 is not particularly limited. For example, a columnar shape as shown in FIG. 7A is suitable, wherein a plurality of grooves 16*g* extending in the axial direction are formed in an outer surface of a columnar body. In this embodiment, the columnar weight member 16 has an approximately crisscross section. The second weight member 16 having such a shape is preferred in enabling use of a large first weight member 15 while securing more weight margin since such a second weight member 16 has a small volume and a light weight. Further, the second weight member 16 may be formed into a hollow body having a hollow portion "k" inside it, as shown in FIG. 7B. Such a weight member can also effectively realize a weight reduction.

In order to secure an adequate rigidity while achieving weight reduction of the second weight member 16, it is preferable that a ratio Sk/Sb of a sectional area Sk of the second weight member 16 to a sectional area Sb of the hollow part 11 is at least 0.45, especially at least 0.5, and is at most 0.8, especially at most 0.75.

Figure 7C:
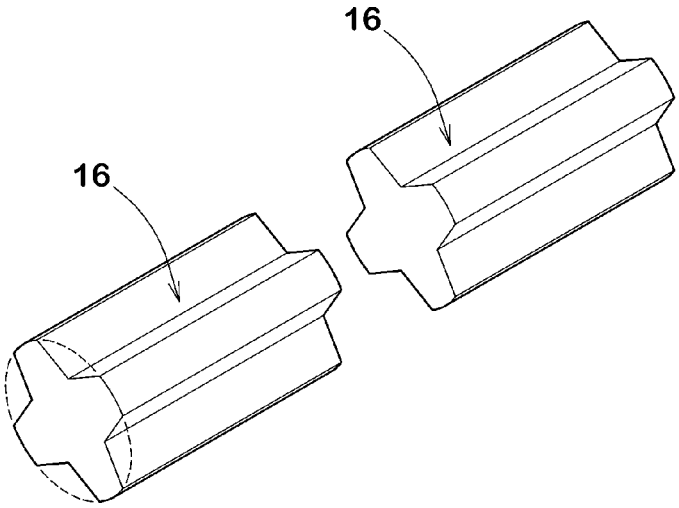
FIG. 7C is a perspective view showing still another example of the second weight member.

Further, as shown in FIG. 7C, the second weight member 16 may be evenly or unevenly divided into two pieces. Since such a second weight member 16 enables to dispose the first weight member 15 at three places, it is easy to adjust the location of the gravity center depth GL.

As shown in FIG. 4, the gravity center adjuster 14 in this embodiment has, in a free state prior to inserting the hollow part 11, a total length (L1+L2+L3) of the length L2 of the first weight member 15, the length L1 of the second weight member 16, and a length L3 of an elastic member 17, and the total length (L1+L2+L3) in the free state is longer than the length L of the hollow part 11. Thus, a compression force generates in the gravity center adjuster 14 when the adjuster 14 is inserted into the hollow part 11 and the cover 13 is attached to the insertion slot 12, whereby the elastic member 17 having the highest elasticity among three members undergoes compression deformation most greatly in the axial direction in an elastic region, and by a reaction force thereto, the first and second weight members 15 and 16 are firmly, positionally fixed in the hollow part 11. Thus, the club head 1 in this embodiment can surely prevent a positional shift of the first and/or second weight members 15 and 16 which may occur by impact of hitting a ball, while securing a large gravity center adjustment mentioned above.

In order to more stably fix the gravity center adjuster 14, it is preferable that a ratio L3'/L3 of a length L3' after the compression of the elastic member 17 to the length L3 before the compression is regulated in a predetermined range. That is to say, in case that the ratio L3'/L3 is too small, it is considered that the rigidity of the elastic member 17 is very small and, therefore, there is a possibility that the locations of the first and second weight members are not stabilized, so the location of the center of gravity of the head 1 changes on its own. If the ratio L3'/L3 is too large, a sufficient reaction force is hard to receive from the elastic member 17, so the location of the center of gravity of the head 1 may change on its own. From such points of view, it is preferable that the ratio L3'/L3 is at least 0.40, especially at least 0.43, more especially at least 0.45, and it is at most 0.70, especially at most 0.67, more especially at most 0.65.

From the viewpoint of stably fixing the gravity center adjuster 14 (first and second weight members 15 and 16), the axial length L3 of the elastic member 17 is preferably at least 3 mm, more preferably at least 3.8 mm. On the other hand, if the length L3 is too large, the length of the first and second weight members is decreased. Therefore, the length L3 is preferably at most 7.5 mm, more preferably at most 6.7 mm. In particular, it is preferable that the length L3 of the elastic member 17 is smaller than the length L2 of the first weight member 15.

Since the elastic member 17 is compressed in its axial direction, it is preferable that in the state prior to the compression, the elastic member 17 has a cross section area smaller than that of the hollow part 11 so as to form a space between the elastic member 17 and the inner surface of the tubular member 10. Thus, the elastic member 17 can expand in a radial direction by a compression force received when attaching the cover 13 to the insertion slot 12, so it can be easily compressed. Therefore, the elastic member 17 having such a size can more firmly fix the first and second weight members 15 and 16 within the hollow part 11.

The material of the elastic member 17 is not particularly limited so long as it undergoes elastic deformation by a compression force generated by attachment of the cover 13. Examples of such an elastic material are, for instance, a cured rubber wherein a rubber such as NBR or IR is vulcanized by a vulcanizing agent, a silicone rubber, a thermoplastic elastomer comprising a soft segment and a hard segment such as a styrene-based thermoplastic elastomer or a urethane-based thermoplastic elastomer, a thermoplastic elastomer such as nylon, a polymer alloy wherein at least two kinds of polymers are blended or chemically bonded.

The smaller the elastic member 17 is, the better in allocating a larger weight to the first weight member 15. Thus, in order to have a sufficient strength and an adequate rigidity, the elastic member 17 is preferred to have a specific gravity pd of at least 0.85 and at most 1.80. Similarly, it is also preferable that the elastic member 17 has a weight Wd of at least 0.3 g and at most 1.0 g. Further, it is preferable that the elastic member 17 has a Shore A hardness Hd of at least 35, especially at least 45, and a Shore A hardness Hd of at most 75, especially at most 67.

A length L4 of the cover 13 along the axial direction of the hollow part 11 is not particularly limited. However, if the length L4 is too large, a large change in the center of gravity tends to be obtained with difficulty since the length of the gravity center adjuster 14 becomes relatively small. On the other hand, if the length L4 is too small, the cover 13 is hard to be attached to the female screw portion 11*n*. From such points of view, it is preferable that the length L4 of the cover 13 is at least 4 mm, especially at least 4.7 mm, and is at most 10 mm, especially at most 9.3 mm. Further, even if the axial length or the like of the female screw portion 11*n* is previously determined, the gravity center adjuster 14 to be inserted into the hollow part 11 is not excessively compressed by the cover 13.

The cover 13 receives a reaction force to a compression force generating in the gravity center adjuster 14. Therefore, the cover 13 is preferred to have a sufficient strength. It is preferable that the cover 13 has a specific gravity ρc of at least 4.0, especially at least 4.4, and at most 8.5, especially at most 8.1. It is also preferable that the cover 13 has a weight We of at least 1.5 g, especially at least 1.7 g, and at most 3.5 g, especially at most 3.2 g.

Preferably, at least one opening 19, especially a plurality of openings 19, are provided in a wall 10*h* facing the head's hollow portion U of the tubular member 10, whereby a weight increase of the head 1 caused by disposing the tubular member 10 can be minimized.

The shape of the opening 19 is not particularly limited. The opening 19 in this embodiment has a horizontally long shape extending in the axial direction of the hollow part 11, e.g., rectangular shape. The axial length Lo of the opening 19 is preferably about 0.30 to about 0.75 times, more preferably about 0.38 to about 0.67 times, the length L of the hollow part 11 of the tubular member 10.

Figure 8A:
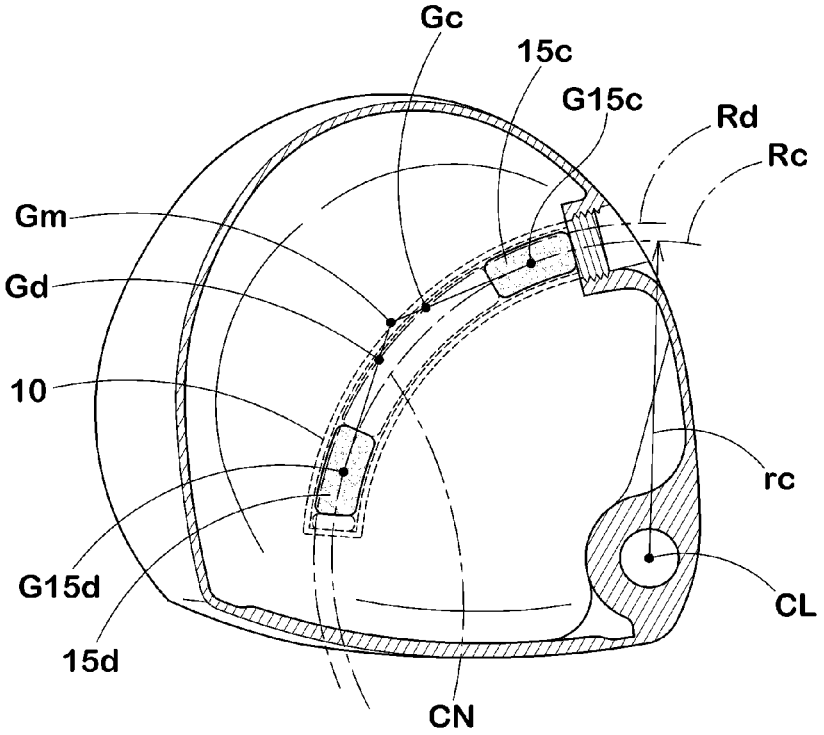
FIGS. 8A and 8B are cross sectional views of golf club heads according to another embodiment of the present invention.
Figure 8B:
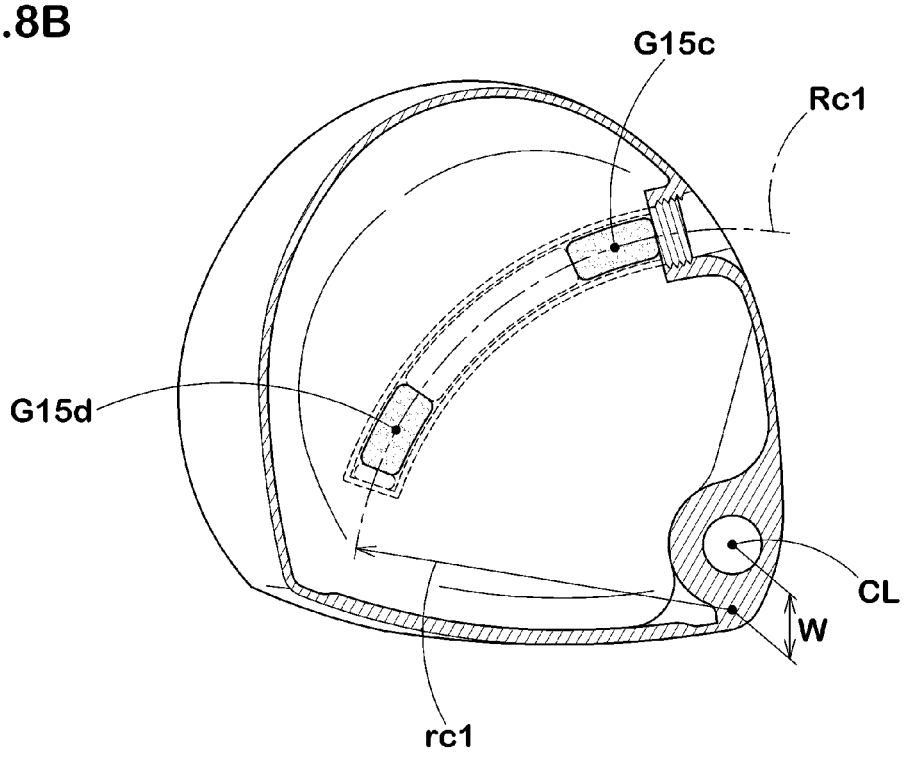

Another embodiment of the present invention is shown in FIGS. 8A and 8B. In this embodiment, the center of gravity G15 of the first weight member 15 moves on a circumference Rc of a circle having its center substantially at the axial center line CL of the shaft-inserting hole 7*a* by the location exchange. In this embodiment, too, the depth GL of the center of gravity of the head can be changed without substantially changing the distance GK of the center of gravity of the head by exchanging the locations of the first and second weight members 15 and 16.

The expression "substantially at the axial center line CL" comprehends not only the movement of the center of gravity G15 of the first weight member 15 on the circumference Rc of the circle having its center at the axial center line CL, but also cases where the center of gravity G15 of the first weight member 15 moves on a circumference Rc1 of a circle having its center at a location away from the axial center line CL by a distance W, as shown in FIG. 8B. From the viewpoint of influence on the gravity center distance with respect to the directionality of a hit ball, it is preferable that the distance W is 3 mm or less.

It is preferable in practicing the embodiment as shown in FIG. 8A that when viewed from above in the vertical state that the shaft-inserting hole 7*a* is set up vertically with respect to the horizontal plane HP, the axial center line CN of the tubular member 10 is curved in a circular arc form so as to extend on the circumference Rc of a circle having a radius "rc" whose center is the axial center line CL of the shaft-inserting hole 7*a*. In such a golf club head 1, since the center of gravity G15 of the first weight member 15 easily moves on the circumference Rc, the center of gravity G of the head 1 also easily moves from Gc to Gd on a circumference Rd of a circle having its center at the axial center line CL of the shaft-inserting hole 7*a*. The radius "rc" of the circumference Rc is preferably at least 36 mm, more preferably at least 38 mm, and is preferably at most 43 mm, more preferably at most 41 mm.

Figure 9:
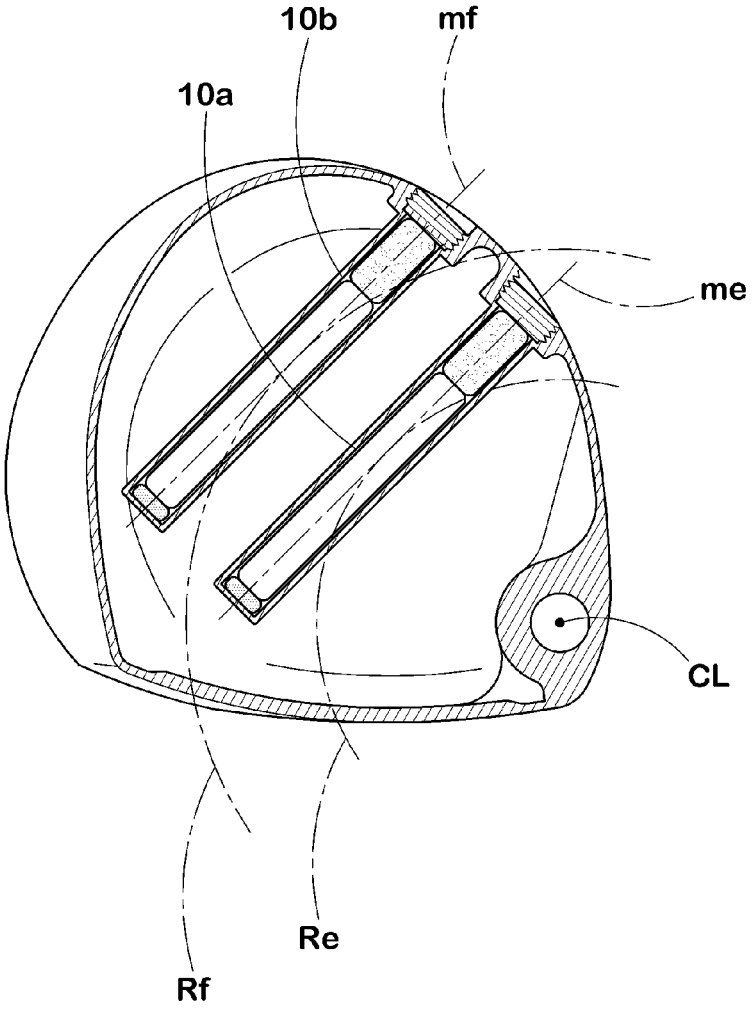
FIG. 9 is a cross sectional view of a golf club head according to still another embodiment of the present invention.

Still another embodiment of the present invention is shown in FIG. 9. The tubular member 10 in this embodiment comprises two tubular members 10*a* and 10*b* each extending in the same direction as a tangent line "me" to a circle Re having its center at the axial center line CL and a tangent line "mf" to a circle Rf having its center at the axial center line CL and having a larger radius than the circle Re. Such a club head 1 can achieve a larger depth or smaller depth of the head's center of gravity without further changing the gravity center distance, since an arrangement pattern of the gravity center adjuster 14 can be changed in each of the tubular members 10*a* and 10*b*.

While preferable embodiments of the present invention have been described with reference to the drawings, it goes without saying that the present invention is not limited to only such embodiments and various changes and modifications may be made. For example, although a wood-type golf club head has been exemplified in the above embodiments, the present invention is of course applicable to various types of golf club heads, e.g., wood-type, putter-type, and utility-type golf club heads.

The present invention is more specifically described and explained by means of the following examples. It is to be understood that the present invention is not limited to these examples.

Examples 1 to 8 and Comparative Examples 1 to 4

Wood-type golf club heads having a base structure of the head body shown in FIGS. 1 to 4 were prepared according to the specifications shown in Table 1.

The respective club heads were prepared by plasma-welding a face plate and a head base body. The face plate was prepared by press molding of a Ti-6Al-4V alloy (specific gravity 4.42), and the head base body was prepared by lost-wax precision casting of the Ti-6Al-4V alloy. Main specifications of the heads are as follows:

Head weight: 195 g
Head volume: 460 $cm^3$
Loft angle: 10.5°
Lie angle: 58.0°

A first weight member made of a stainless steel (specific gravity 7.8) and a second weight member made of a polyethylene (specific gravity 0.94) were used as a gravity center adjuster, and they were formed into a columnar shape. The depth of the center of gravity of the heads was changed by using weight members having different lengths L1 and L2. The weight members used in Comparative Examples have the same weight as the corresponding weight members used in Examples, but have a different sectional area (different outer diameter) from the corresponding weight members used in the Examples. Similarly, the head bodies per se have the same weight and the same location of the center of gravity, but the thickness of the wall and the diameter of the tubular members were changed. The cover was formed from a stainless steel and the elastic member was formed from a silicone rubber, and those having common weights were used in both the Examples and the Comparative Examples.

Same shafts (SV-3003J, flex SR, made by SRI Sports Limited) were attached to all club heads to be tested to give wood-type gold clubs. Each of ten right-hitting golfers having a handicap of 8 to 15 struck 10 golf balls with each club. The test was made for the heads wherein the depth of the center of gravity was made small by the location exchange of the weight members, and for the heads wherein the depth of the center of gravity is made large.

When golf balls were struck by the heads having a small depth of the center of gravity, estimation was made as follows:

A (excellent): golf club by which 9 or more balls could be struck freely in a desired direction
B (good): golf club by which 7 or 8 balls could be struck freely in a desired direction
C: golf club by which 5 or 6 balls could be struck freely in a desired direction
D: golf club by which 3 or 4 balls could be struck freely in a desired direction
E (bad): golf club by which at most two balls could be struck freely in a desired direction When gold balls were struck by the heads having a large depth of the center of gravity, estimation was made as follows:

A (excellent): golf club by which 9 or more balls could be struck straight
B (good): golf club by which 7 or 8 balls could be struck straight
C: golf club by which 5 or 6 balls could be struck straight
D: golf club by which 3 or 4 balls could be struck straight
E (bad): golf club by which at most two balls could be struck straight A better result was adopted for each golfer, and a rating for which the largest number of golfers had estimated was adopted as a test result.

The test results are shown in Table 1.

TABLE 1

Figure 10A:
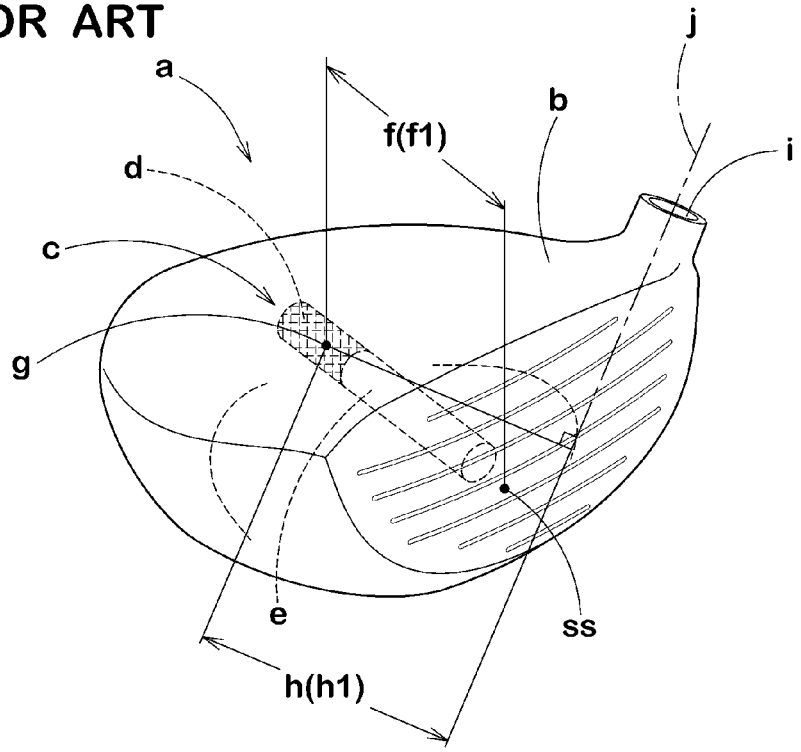
FIG.10A PRIOR ART
FIGS. 10A and 10B are perspective views of a golf club head for illustrating prior art.
Figure 10B:
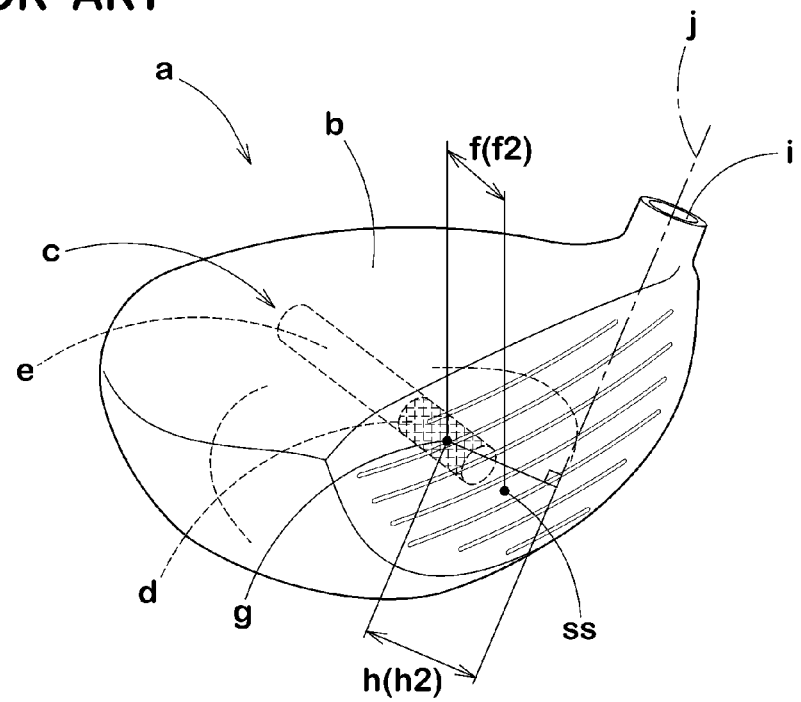
FIG.10B PRIOR ART

| | Com. Ex. 1 | Com. Ex. 2 | Com. Ex. 3 | Com. Ex. 4 | Ex. 1 | Ex. 2 |
|---|---|---|---|---|---|---|
| Drawing showing structure of club head | FIG. 10 | FIG. 5 | FIG. 5 | FIG. 5 | FIG. 5 | FIG. 5 |
| Amount of change in gravity center depth (mm) | 6 | 8 | 8 | 8 | 2 | 5 |
| Amount of change in gravity center distance (mm) | 10 | 2 | 5 | 8 | 0 | 0 |
| Radius of circumference on which the center of gravity of first weight member moves (mm) | — | 34 | 34 | 34 | 34 | 34 |
| Hitting test | E | D | D | E | C | B |
| | Ex. 3 | Ex. 4 | Ex. 5 | Ex. 6 | Ex. 7 | Ex. 8 |
| Drawing showing structure of club head | FIG. 5 | FIG. 5 | FIG. 5 | FIG. 5 | FIG. 8A | FIG. 9 |
| Amount of change in gravity center depth (mm) | 8 | 5 | 8 | 8 | 8 | 8 |
| Amount of change in gravity center distance (mm) | 0 | 0 | 0 | 0 | 0 | 0 |
| Radius of circumference on which the center of gravity of first weight member moves (mm) | 34 | 36 | 36 | 43 | 40 | 40 |
| Hitting test | B | B | A | A | A | B |

The first weight member and the cover were prepared by machining using an NC cutting machine, and the second weight member and the elastic member were prepared by injection molding.

An "amount of change in gravity center depth" and an "amount of change in gravity center distance" were measured as a difference in gravity center depth and a difference in gravity center distance after exchanging the locations of the first and second weight members inserted into the hollow part of the tubular member.

From the results shown in Table 1, it is confirmed that the golf club heads of the Examples according to the present invention have received a high evaluation as a golf club head capable of changing the depth of the center of gravity.

What is claimed is:

1. A golf club head having a face for hitting a golf ball, a shaft-inserting hole to attach a shaft and a hollow interior, said golf club head comprising a hollow head body and a gravity center adjuster fixed to said hollow head body, said gravity center adjuster comprising a first weight member and a second weight member having a lower specific gravity than said first weight member, said first and second weight members being provided in said hollow head body so that the locations thereof are interchangeable with each other, whereby a depth of the center of gravity which is a distance from the center of gravity of said head to a sweet spot of said face can be changed without substantially changing a distance of the center of gravity which is the shortest distance from an axial center line of said shaft-inserting hole to the center of gravity of said head, wherein the center of gravity of said first weight member is movable substantially on the circumference of a circle having a center that is an axial center line of said shaft-inserting hole by the interchangeable locations of said first and second weight members.

2. The golf club head of claim 1, wherein said hollow head body includes a tubular member having an insertion slot opened at an outer surface of said head, a bottom and a hollow part for inserting said gravity center adjuster, said hollow part extending from said insertion slot into the head's hollow interior and terminating at said bottom; and a cover attached to said insertion slot for preventing said gravity center adjuster from falling out of said hollow part.

3. The golf club head of claim 2, wherein said tubular member has a wall facing said hollow interior of the head, and said wall is provided with at least one opening extending in an axial direction of said hollow part.

4. The golf club head of claim 2, wherein said gravity center adjuster further includes an elastic member having a lower specific gravity and a lower elasticity than those of said first and second weight members, and said elastic member is disposed in said hollow part of said tubular member in a state of being compressed in an axial direction of said tubular member.

5. The golf club head of claim 2, wherein a length L2 of said first weight member having a larger specific gravity which is measured along an axial direction of said hollow part is smaller than a length L1 of said second weight member having a smaller specific gravity which is measured along the axial direction of said hollow part.

6. The golf club head of claim 2, wherein said tubular member is fixed to a sole portion of said head through a supporting member by welding, or by integral molding by means of casting.

7. The golf club head of claim 2, wherein said tubular member is formed from a material having a smaller specific gravity than a sole portion of said head, and is fixed to said sole portion by adhesion or mating.

8. The golf club head of claim 1, wherein said second weight member is divided into two pieces.

9. The golf club head of claim 1, wherein said first weight member has a weight of 8.0 to 20.0 g and said second weight member has a weight of 2.5 to 4.5 g.

10. A golf club head having a face for hitting a golf ball, a shaft-inserting hole to attach a shaft and a hollow interior, said golf club head comprising a hollow head body and a gravity center adjuster fixed to said hollow head body, said gravity center adjuster comprising a first weight member and a second weight member having a lower specific gravity than said first weight member, said first and second weight members being provided in said hollow head body so that the locations thereof are interchangeable with each other, whereby a depth of the center of gravity which is a distance from the center of gravity of said head to a sweet spot of said face can be changed without substantially changing a distance of the center of gravity which is the shortest distance from an axial center line of said shaft-inserting hole to the center of gravity of said head, wherein the center of gravity of said first weight member is movable substantially on the circumference of a circle having a center that is an axial center line of said shaft-inserting hole by the interchangeable locations of said first and second weight members, and wherein said circle has a radius of 36 to 43 mm.

11. The golf club head of claim 10, wherein said second weight member is divided into two pieces.

12. The golf club head of claim 10, wherein said first weight member has a weight of 8.0 to 20.0 g and said second weight member has a weight of 2.5 to 4.5 g.

13. A golf club head having a face for hitting a golf ball, a shaft-inserting hole to attach a shaft and a hollow interior, said golf club head comprising a hollow head body and a gravity center adjuster fixed to said hollow head body, said gravity center adjuster comprising a first weight member and a second weight member having a lower specific gravity than said first weight member, said first and second weight members being provided in said hollow head body so that the locations thereof are interchangeable with each other, whereby a depth of the center of gravity which is a distance from the center of gravity of said head to a sweet spot of said face can be changed without substantially changing a distance of the center of gravity which is the shortest distance from an axial center line of said shaft-inserting hole to the center of gravity of said head, and wherein said gravity center adjuster is disposed in a tubular member comprising an insertion slot opened at an outer surface on a heel side of a side portion of said head, a bottom and a hollow part extending from said insertion slot into the head's hollow interior, and said tubular member is disposed so that its axis is located in a plane perpendicular to an axial center line of said shaft-inserting hole.

14. The golf club head of claim 13, wherein said hollow part extends straight along a tangent line to a circle having its center at the axial center line of said shaft-inserting hole.

15. The golf club head of claim 13, wherein said tubular member is in a curved tubular form, and said hollow part extends substantially on the circumference of a circle having its center at the axial center line of said shaft-inserting hole.

16. The golf club head of claim 13, wherein said second weight member is divided into two pieces.

17. The golf club head of claim 13, wherein said first weight member has a weight of 8.0 to 20.0 g and said second weight member has a weight of 2.5 to 4.5 g.

* * * * *